United States Patent [19]

Stewart

[11] 4,061,962

[45] Dec. 6, 1977

[54] CURRENT MIRROR AMPLIFIER AUGMENTATION OF REGULATOR TRANSISTOR CURRENT FLOW

[75] Inventor: Roger Green Stewart, Neshanic Station, N.J.

[73] Assignee: RCA Corporation, New York, N.Y.

[21] Appl. No.: 695,189

[22] Filed: June 11, 1976

[51] Int. Cl.[2] ..... G05F 1/56

[52] U.S. Cl. ..... 323/22 R; 307/23; 307/297; 330/288; 323/16; 330/277; 330/297

[58] Field of Search ..... 323/4, 9, 16, 22 R, 323/22 T; 317/33 VR; 307/235 T, 296, 297; 330/30 D, 22, 35; 361/18

[56] References Cited

U.S. PATENT DOCUMENTS

| | | | |
|---|---|---|---|
| 3,743,923 | 7/1973 | Steudel | 323/22 R |
| 3,757,200 | 9/1973 | Cohen | 323/22 R |
| 3,813,595 | 5/1974 | Sheng | 323/4 |
| 3,925,178 | 12/1975 | Wittlinger | 307/297 |
| 3,943,380 | 3/1976 | Morgan et al. | 307/235 T |

OTHER PUBLICATIONS

*Applications of Operational Amplifiers* by G. Graeme, 1973, pp. 84–86.

*Primary Examiner*—Gerald Goldberg
*Attorney, Agent, or Firm*—H. Christoffersen; S. Cohen; A. L. Limberg

[57] ABSTRACT

A NMOS transistor in the input current path of a PMOS current mirror amplifier senses any tendency to change of the voltage across a load driven by the output current of the amplifier. In response thereto, the NMOS transistor changes the input current of the amplifier to thereby vary its output current in a sense to maintain the voltage across the load constant.

9 Claims, 1 Drawing Figure

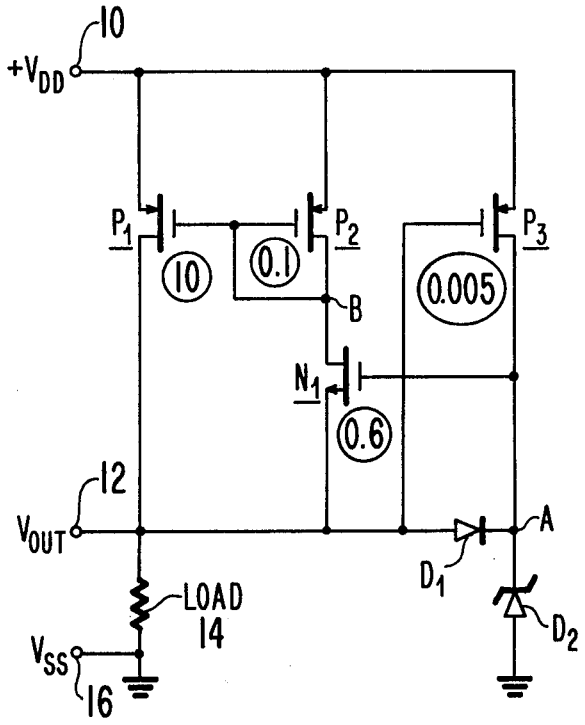
10
+V_DD
P1
P2
P3
10
0.1
0.005
B
N1
0.6
12
V_OUT
A
D1
D2
LOAD
14
V_SS
16

CURRENT MIRROR AMPLIFIER AUGMENTATION OF REGULATOR TRANSISTOR CURRENT FLOW

The present invention relates to voltage regulators.

There is a continuing need in the electronics art for efficient voltage regulation circuits. Especially in integrated circuits where space may be at a premium and where power consumption should be minimal, there is often a need for a voltage regulator which requires relatively few components, which can regulate over a large range of load currents and power supply voltage variation, and which draws little power aside from that used by the load. The circuit of the present application is designed to meet these needs.

The sole FIGURE is a schematic diagram of a voltage regulator embodying the invention.

The regulator illustrated comprises a first P type MOS transistor $P_1$ which is connected at its source electrode to terminal 10 to which a supply voltage $+V_{DD}$ may be applied and which is connected at its drain electrode to circuit output terminal 12. Transistor $P_1$ is connected at its gate electrode to node B at the gate electrode of a second P-type MOS transistor $P_2$. The latter is connected at its source electrode to terminal 10 and at its drain electrode to its gate electrode and to the drain electrode of N-type MOS transistor $N_1$. The latter is connected at its source electrode to terminal 12 and at its gate electrode to node A at the cathode electrode of Zener diode $D_2$ and the drain electrode of P-type MOS transistor $P_3$. The Zener diode is connected at its anode electrode to ground. The source electrode of transistor $P_3$ is connected to terminal 10 and its gate electrode is connected to output terminal 12. A diode $D_1$ is connected between output terminal 12 and node A of the circuit. The load 14 is connected between output terminal 12 and the supply voltage $V_{SS}$ terminal 16, $V_{SS}$ being at ground in this example.

The circled numbers next to the various transistors represent scaling factors. Each can represent, for example, the relative, effective width-to-length ratio of the conduction path of the transistor. The number 10 next to transistor $P_1$ indicates that it is a relatively large transistor and can conduct a substantial amount of current in the 10 mA range in one particular application, where $V_{DD}$ is $+10$ volts. The number 0.005 next to current supply transistor $P_3$ indicates a very small transistor capable of drawing only a minute amount of current—less than 3 $\mu$A in this particular application. The transistors are all field-effect transistors of the enhancement type.

The transistors $P_1$ and $P_2$ are interconnected to form a P-type current mirror amplifier, $P_1$ being the output transistor thereof and $P_2$ the input transistor. The common terminal of this amplifier is at 10, the input terminal at node B and the output terminal at 12. Control transistor $N_1$ is connected in "common gate" configuration, that is, its gate electrode is connected to node A, which node is maintained at a reference voltage level of about 6 volts in one particular application. While the reference voltage means is illustrated as transistor $P_3$ connected essentially in series with a Zener diode $D_2$, other such reference voltage means may be employed instead. For example, a string of diodes connected in series in the forward direction between node A and ground may be used to replace the Zener diode; means other than $P_3$ may be employed to supply current. Control transistor $N_1$ senses the output voltage $V_{OUT}$ at its source electrode.

In operation, the circuit regulates the voltage appearing across load 14 to a value $V_A - V_{TH}$, where $V_A$ is the voltage at node A and $V_{TH}$ is the threshold voltage of transistor $N_1$. This threshold voltage may be a value such as 1 volt so that the load voltage appearing between terminals 12 and 16 is regulated to approximately 5 volts.

Should the voltage at terminal 12 tend to become less positive than the value at which it is being regulated, the source electrode of transistor $N_1$ becomes less positive, thereby increasing the source-to-gate voltage of $N_1$ and thereby reducing its conduction path impedance. This pulls node B at the common gate-to-drain connection of transistor $P_2$ less positive and causes the input current of the current mirror amplifier to increase, that is, it causes $P_2$ to draw more current. This causes the output transistor $P_1$ of the current mirror amplifier to pass more output current to the load 14 to thereby increase the voltage across the load to the design value. Should the voltage across the load tend to increase above its design value, the input current to the current mirror will be decreased in complementary fashion to that just discussed and this will result in a decrease in the output current of the current mirror and a corresponding decrease in the voltage across the load to its design value.

The regulation just discussed occurs at high speed, that is, the circuit has considerable gain. The current gain of the current mirror amplifier is proportional to the scaling ratio of transistor $P_1$ to transistor $P_2$ which, in this particular example, is 100:1. The gain of the control transistor $N_1$ is roughly proportional to the square root of the transconductance ratio between transistors $N_1$ and $P_2$ which, in this particular example is about 3.5. This gives a total loop gain of 350:1.

Should the load 14 be open circuited, the transistor $N_1$ turns off driving node B high and turning off both transistors $P_1$ and $P_2$ of the current mirror amplifier. However, transistor $P_3$ remains on and a trickle of current (less than 3 $\mu$A, as already mentioned) flows through the transistor $P_3$ and Zener diode $D_2$ to maintain node A at the reference level of approximately 6 volts. Under these conditions, output terminal 12 "floats" but its voltage is maintained within a relatively narrow range. If it should tend to increase in value above $V_{D_1}+V_A$, where $V_{D_1}$ is the voltage drop across the diode $D_1$, the diode $D_1$ will conduct and clamp the voltage at terminal 12 to the value $V_{D_1}+V_A$. This is approximately 6.6 volts or so, assuming $V_A \cong 6$volts and $V_{D_1} \cong 0.6$ volt. If the voltage at terminal 12 should tend to decrease to a value lower than 5 volts, the regulator will go on and regulate the voltage at terminal 12 to the design value of 5 volts. Within this narrow voltage range, the gate electrode of transistor $P_3$ is sufficiently negative, relative to the voltage at its source electrode to maintain transistor $P_3$ in conduction.

The purpose of the diode $D_1$ aside from that just discussed, is to eliminate any positive transients which may attempt to develop across load 14. Any such transients cause conduction of diode $D_1$ to prevent output terminal 12 from going substantially more positive than the design value of about 5 volts.

An important feature of the circuit just described is its simplicity, that is, the relatively small number of components needed. These readily can be integrated and require only a small area on the integrated circuit substrate. Another feature of the circuit is that aside from the power used by the load, the regulator circuit itself dissipates little power. In standby (load circuit open), everything is off except for transistor $P_3$ and Zener diode $D_2$, and these two elements draw less than 3 $\mu$A. Another feature of the circuit is that field effect transistor $N_1$ operated in the common gate mode can be connected at its gate electrode to a high-impedance, low-current reference voltage node. Another feature of the present circuit is that it can regulate the output voltage over a large range of currents and also over a relatively large range of variation of the supply voltage $V_{DD}$. A reason for the relative insensitivity of the circuit to variations of $V_{DD}$ is that since transistor $N_1$ acts as a current sink, node B will track variations in $V_{DD}$. In other words, as $V_{DD}$ varies, the voltage between nodes B and 12 will vary in the same sense so as to maintain the load voltage $V_{OUT}$ at its regulated value. Of course, there are limits. For example, $V_{DD}$ must be sufficiently high for the transistors to conduct and for the reference voltage means $P_3$, $D_2$ to develop at A the required dc reference voltage level.

What is claimed is:

1. A voltage regulator circuit for regulating the voltage between two terminals for a load comprising, in combination:

first and second operating voltage terminals, said second operating voltage terminal being connected to one of said load terminals;

a current mirror amplifier formed of transistors of one conductivity type, said amplifier having common, input and output terminals, and being connected at its common terminal to said first operating voltage terminal and at its output terminal to the other of said load terminals;

a control transistor of a conductivity type complementary to that of the current mirror amplifier transistors, having input, output and control electrodes, connected at its output electrode to the input terminal of said current mirror amplifier and at its input electrode to said other of said load terminals;

reference voltage means independent of said control transistor, which reference voltage means develops a voltage of given value thereacross when it conducts;

means connected across said reference voltage means for causing continuous conduction of current therethrough; and means for applying said voltage of given value between one of said operating voltage terminals and the control electrode of said control transistor to develop a potential at the control electrode of said control transistor which is in the forward direction relative to the voltage at the input electrode of said control transistor.

2. A voltage regulator as set forth in claim 1, wherein said transistors are all field-effect transistors.

3. A voltage regulator as set forth in claim 2, wherein said current mirror amplifier comprises first and second field effect transistors, each having source, gate and drain electrodes, said source electrodes being connected to one another at said common terminal, said base electrodes being connected to one another and to the drain electrode of said second transistor at said output terminal, and said drain electrode of said first transistor being at said input terminal.

4. A voltage regulator as set forth in claim 3, wherein said control transistor comprises a field effect transistor having a source electrode serving as said input electrode, a gate electrode serving as said control electrode and a drain electrode serving as said output electrode.

5. A voltage regulator as set forth in claim 3, wherein said current mirror amplifier comprises one which exhibits an output-to-input current gain of at least 10.

6. A voltage regulator as set forth in claim 1, wherein said means for causing continuous conduction comprises a field effect supply transistor having a conduction path in series with said reference voltage means, said conduction path being dimensioned to pass current only in the microampere range.

7. A voltage regulator as set forth in claim 6, wherein said supply transistor has gate, source and drain electrodes and is of the same conductivity type as the transistors of said current mirror amplifier, said supply transistor being connected to its source electrode to said first operating voltage terminal, at its drain electrode to said reference voltage means and at its gate electrode to said other of said load terminals, and further including:

diode means connected between the gate and drain electrodes of said supply transistor and poled to conduct current in the same direction as said reference voltage means relative to said gate electrodes.

8. A voltage regulator as set forth in claim 1, further comprising:

diode means connected between said input electrode of said control transistor and said source of reference voltage poled to conduct in the forward direction when the potential difference between the control and input electrodes of said control transistor is of a sense to inhibit conduction through said control transistor.

9. In a circuit including a first field effect transistor being of a first conductivity type and having drain, source and gate electrodes; and a three-terminal current amplifier having an input terminal to which the drain electrode of said first field effect transistor is connected, having an output terminal from which an amplified and inverted current response to the drain current flow of said first field effect transistor is supplied to the source electrode of said first field effect transistor to augment its source current flow, and having a common terminal, the improvement wherein said current amplifier comprises:

second and third field effect transistors each being of a second conductivity type complementary to said first conductivity type, being of enhancement type, and having drain and source and gate electrodes, said second transistor having a scaling factor or width-to-length ratio that is relatively small compared to that of said first transistor, whereby said first and second transistors co-operate as a voltage amplifier with gain in excess of unity;

connections of the source electrodes of said second and third field transistors to the common terminal of said current amplifier;

connection of the input terminal of said current amplifier to the drain electrode of said second field effect transistor;

connection of the drain electrode of said third field effect transistor to the output terminal of said current amplifier; and an interconnection between the base electrodes of the second and third field effect transistors to which the input terminal of said current amplifier is connected.

* * * * *